US005322213A

United States Patent [19]

Carter et al.

[11] Patent Number: 5,322,213

[45] Date of Patent: Jun. 21, 1994

[54] STACKABLE CONTAINER

[75] Inventors: Alan T. Carter, Sturgis; Kirk A. Myers, Union, both of Mich.

[73] Assignee: Carter Associates, Inc., Sturgis, Mich.

[21] Appl. No.: 29,798

[22] Filed: Mar. 10, 1993

[51] Int. Cl.[5] ..... B65D 5/50

[52] U.S. Cl. ..... 229/166; 206/511; 206/512; 229/199; 229/915

[58] Field of Search ..... 206/509, 511, 512; 220/418, 445; 229/166, 199, 915, 918, 919, DIG. 2, DIG. 11

[56] References Cited

U.S. PATENT DOCUMENTS

| | | | |
|---|---|---|---|
| 2,791,365 | 5/1957 | Cohen | 229/DIG. 11 |
| 2,947,462 | 8/1960 | Bostock | 229/199 |
| 2,954,914 | 10/1960 | Herlihy | 229/199 |
| 4,046,312 | 9/1977 | Krizan | 229/166 |
| 4,165,031 | 8/1979 | Osborne | 229/166 |
| 4,561,706 | 12/1985 | Grati | 229/166 |
| 4,682,727 | 7/1987 | Stoll | 229/915 |
| 4,720,013 | 1/1988 | Nichols et al. | 229/915 |
| 4,762,270 | 8/1988 | Stoll et al. | 229/DIG. 2 |
| 4,919,267 | 4/1990 | Stoll | 229/915 |
| 4,948,039 | 8/1990 | Amatangelo | 220/445 |

OTHER PUBLICATIONS

Sketch of prior art container (1 page), dated May 14, 1993.

*Primary Examiner*—Gary E. Elkins

*Attorney, Agent, or Firm*—Flynn, Thiel, Boutell & Tanis

[57] ABSTRACT

A storage container or bin primarily constructed of extruded fluted plastic panels. The container includes two opposed pairs of generally parallel side walls, each side wall including at least one upright extruded plastic panel disposed with the flutes extending vertically to provide vertical column strength. A stacking and reinforcing loop of metal rod is positioned in direct load-bearing engagement with the upper edges of the side walls, with the rod being fixedly secured to each side wall by securing flanges which are integral with the fluted material defining the side walls and which snugly wrap around the top rod and are fixedly secured to the respective side wall. The top stacking rod is provided with a stacking bracket adjacent each corner of the container, which bracket is positioned outwardly and upwardly of the reinforcing rod to secure and cooperate with a lower corner of a second container when the latter is vertically stacked on the top stacking rod of the first container.

14 Claims, 8 Drawing Sheets

STACKABLE CONTAINER

FIELD OF THE INVENTION

This invention relates to an open boxlike container or bin constructed primarily of extruded plastic panels and, in particular, to a construction having improved reinforcing and stacking features.

BACKGROUND OF THE INVENTION

Boxlike containers or bins, often referred to as "totes", are conventionally constructed of extruded plastic panels which have inner and outer sheetlike plastic layers transversely and rigidly joined together by a plurality of parallel ribs which define elongated flutes or channels. These plastic panels are utilized for defining the walls of the container, including both the bottom and side walls, with the top of the container conventionally being open. These plastic panels provide an economical construction technique and at the same time provide a container having reasonable strength and durability. In order to provide proper strength around the open top of the container, however, it is often necessary to provide a looplike reinforcing rod which is positioned to exteriorly surround the container side walls adjacent the upper edges thereof. In one known construction, the side walls have upper flaps which are folded outwardly and downwardly so as to partially surround and support the reinforcing loop in surrounding relationship to the side walls. With this known construction, the reinforcing loop functions solely to provide circumferential reinforcement around the side walls so as to prevent outward expansion thereof, and provides no other advantageous function. In this known container, stacking of loaded containers on top of one another is not feasible, and in fact the containers are not suitably designed to permit vertical load transfer between stacked containers, nor do they safely permit vertically stacked containers to be securely retained on top of one another.

Accordingly, it is an object of this invention to provide an improved storage container or bin which improves upon containers of the general type described above, and in particular relates to an improved container which is primarily constructed of extruded fluted plastic panels, and which provides adequate vertical strength associated with the container side walls and improved stacking characteristics associated with the containers so as to permit similar such containers to be vertically and securely stacked on top of one another.

In the improved container of the present invention, the container includes two opposed pairs of generally parallel side walls, each side wall including at least one upright extruded plastic panel disposed with the flutes extending vertically so as to provide vertical column strength. A stacking and reinforcing loop of metal rod is positioned in direct load-bearing engagement with the upper edges of the side walls, with the rod being fixedly secured to each side wall by appropriate securing flanges which are integral with the fluted material defining the side wall and which snugly wrap around the top rod and are fixedly secured to the respective side wall. The top stacking rod is also provided with a stacking bracket adjacent each corner of the container, which bracket is positioned outwardly and upwardly of the reinforcing rod so as to secure and cooperate with a lower corner of a second container when the latter is vertically stacked on a first said container, with the bottom wall of the second container being positioned vertically directly on the top stacking rod of the first container.

In the improved container, as briefly described above, the flaps which secure the top stacking rod are preferably provided with undercut grooves therein which extend through one outer sheet of the plastic panel, and also partially and transversely through the intermediate ribs, thereby leaving primarily only the other outer sheet which functions as a hinge portion so as to wrap around the top of the rod with the latter being secured within the undercut groove.

Other objects and purposes of the invention will be apparent to persons familiar with structures of this general type upon reading the following specification and inspecting the accompanying drawings.

Figure 1:
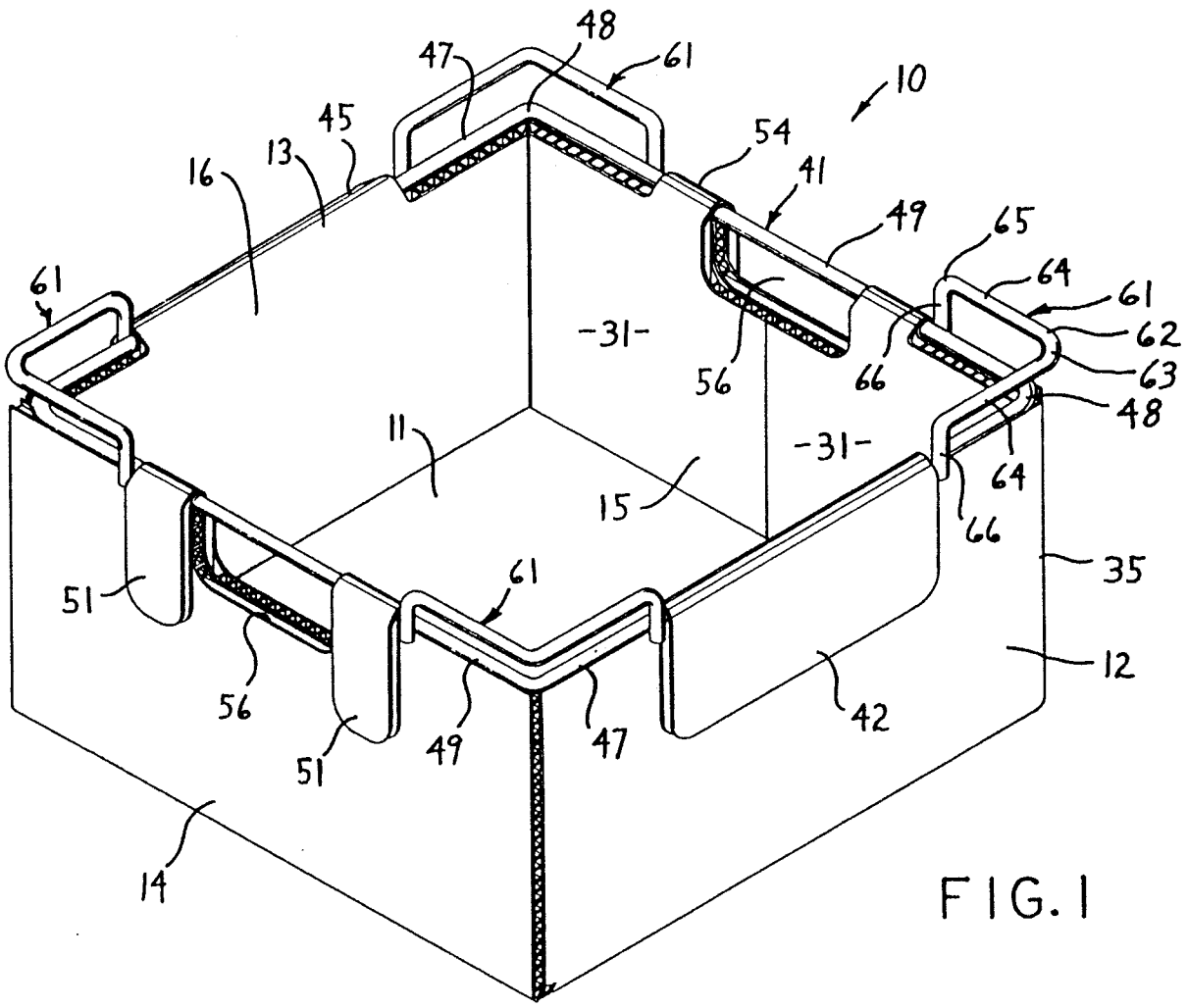
FIG. 1 is a perspective view of a storage container according to the present invention.
Figure 2:
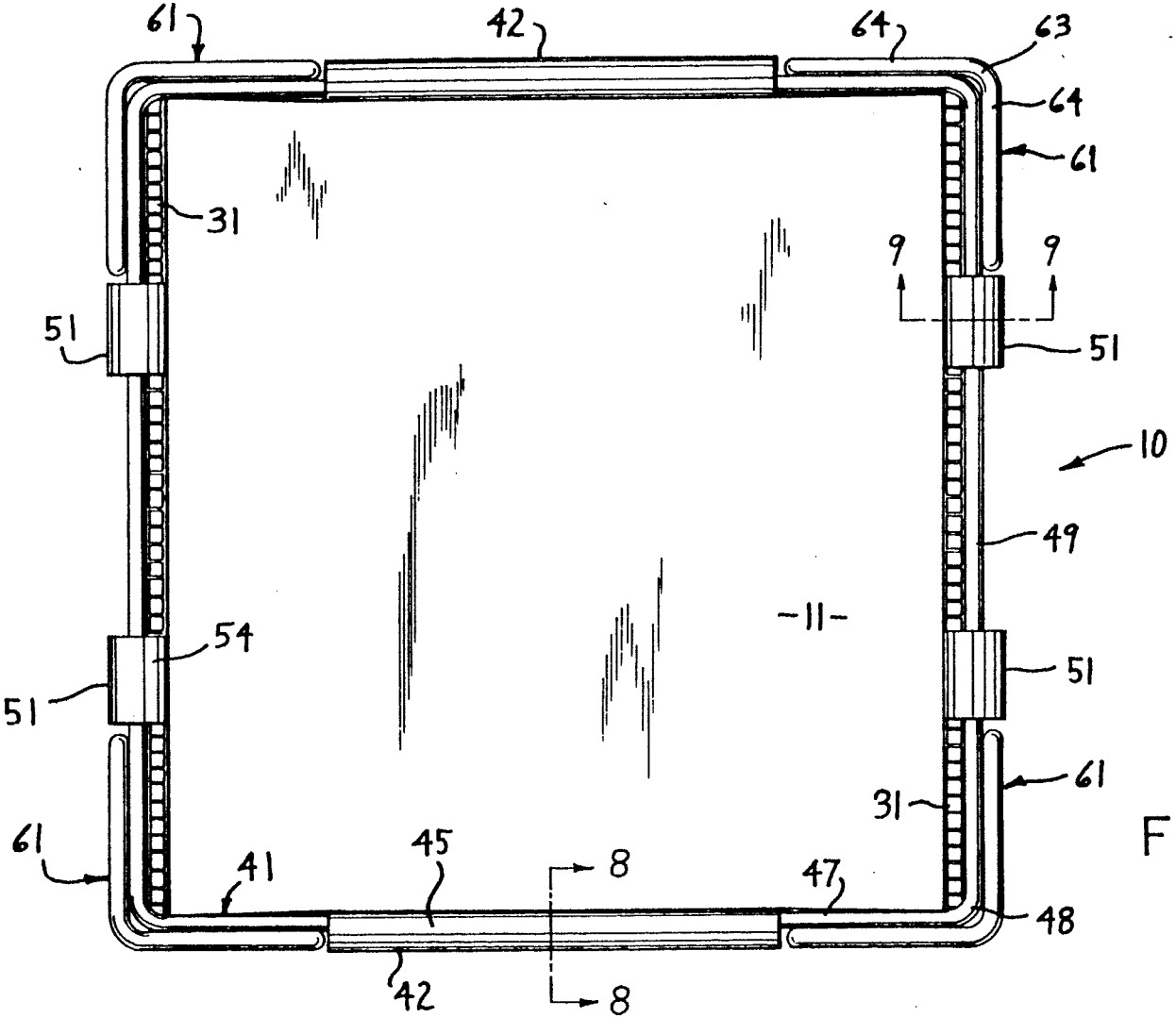
FIG. 2 is a top view of the container of FIG. 1.
Figure 3:
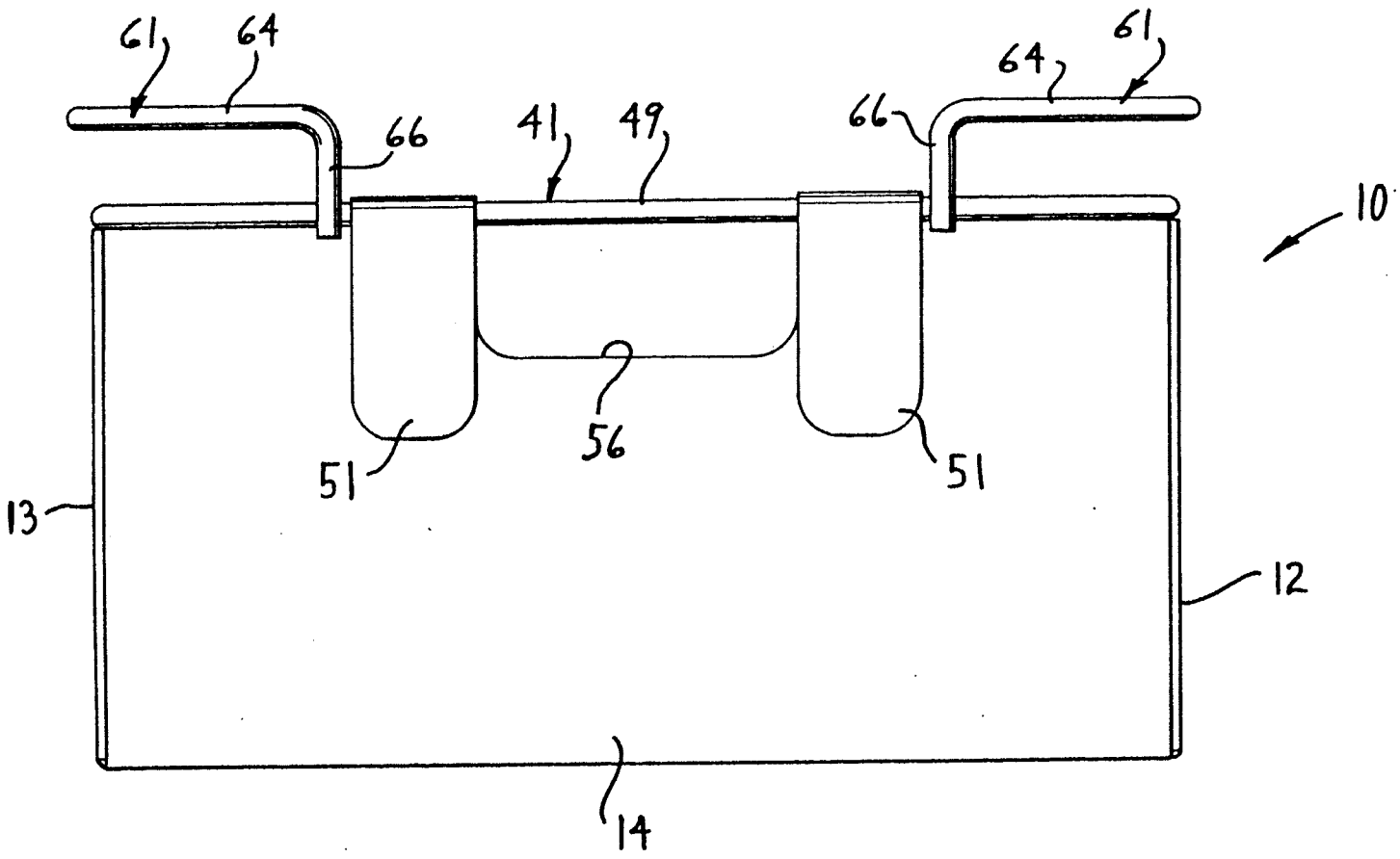
FIGS. 3 and 4 are side elevational views showing the mutually perpendicular sides of the container.
Figure 4:
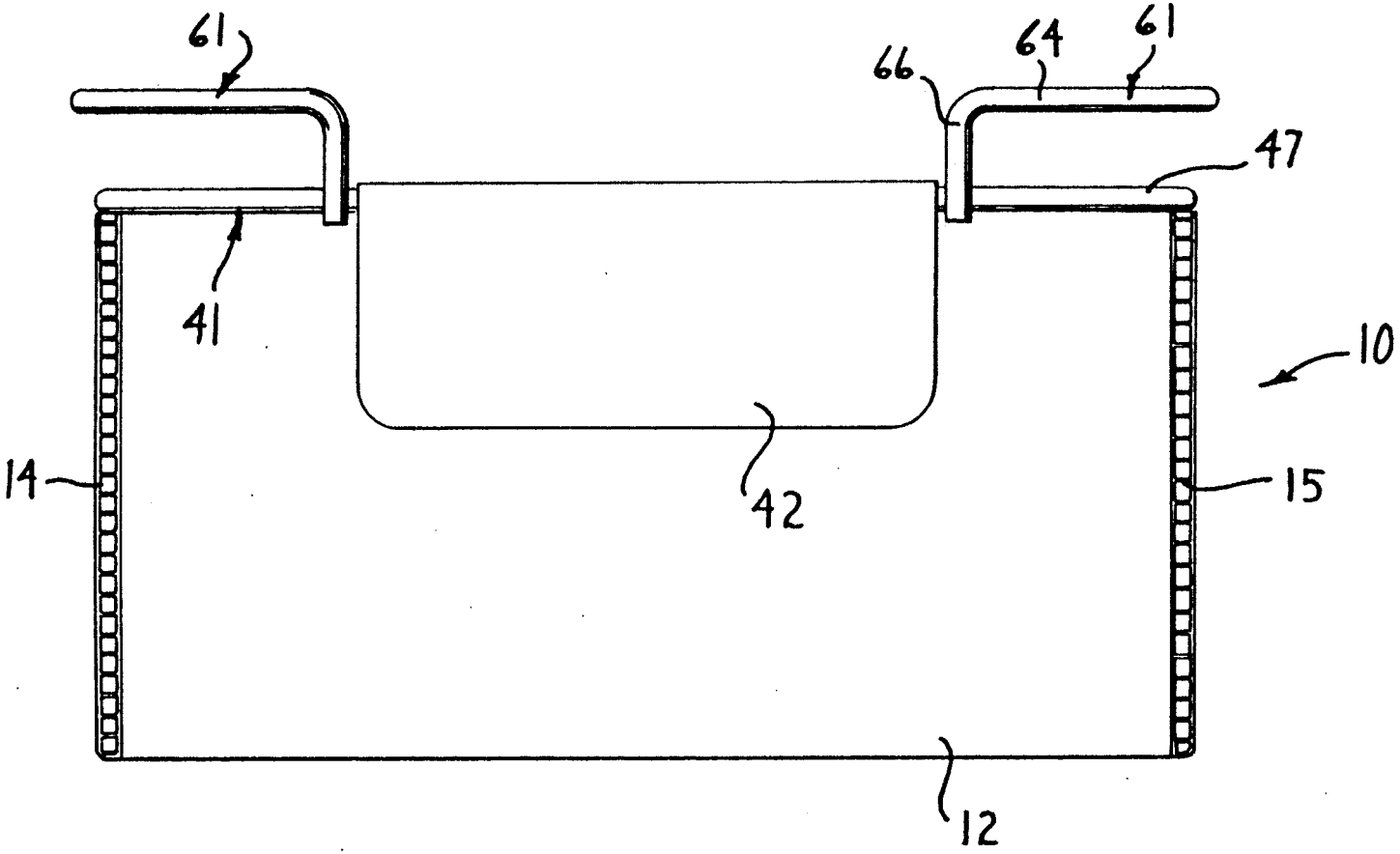

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the container and designated parts thereof. Said terminology will include the words specifically mentioned, derivatives thereof, and words of similar import.

DETAILED DESCRIPTION

Referring to the drawings, there is illustrated an open boxlike container or bin or tote 10 according to the present invention. The container includes a generally horizontally planar bottom wall 11, a first pair of generally parallel side walls 12 and 13 which project upwardly in generally vertical relationship from opposite edges of the bottom wall 11, and a further pair of generally parallel side walls 14 and 15 which project generally vertically upwardly from the remaining edges of the bottom wall 11. The side walls 14 and 15 extend generally perpendicularly between opposite end edges of the side walls 12 and 13, whereby the side walls in cooperation with the bottom wall define an interior storage compartment 16. The top of the container is open to provide ready access to the storage compartment.

Figure 6:
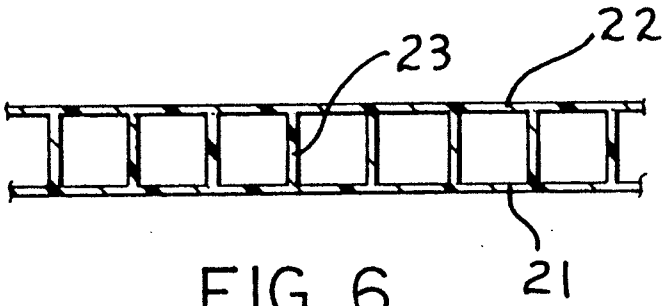

In the container 10, all of the bottom and side walls are preferably constructed from a generally rigid extruded plastic panel which, as illustrated by FIG. 6, includes a pair of generally parallel and laterally spaced outer plastic sheets (i.e., side sheets) 21 and 22 joined by a plurality of generally parallel ribs 23 extending transversely therebetween, which ribs in cooperation with the side sheets define a plurality of elongated flutes or channels which extend in parallel relationship in the direction of extrusion of the plastic panel. Such extruded plastic panels are conventional and well known, and in the container of the present invention the plastic panels used for defining the walls are typically about ¼ inch thick, although other thicknesses can be utilized if desired depending upon the configuration and load requirements of the container.

The container 10 of FIGS. 1–4 is, in the illustrated embodiment, constructed from a one-piece flat blank 24 (FIG. 5) which is cut from an extruded plastic panel. This blank defines thereon the various walls of the container. More specifically, the blank is oriented such that the flutes extend longitudinally across the bottom wall so that the opposed side walls 12 and 13 are integrally joined to opposite edges of the bottom wall through suitable parallel fold lines 33, which fold lines extend perpendicularly across the elongate direction of the flutes so that when the side walls 12 and 13 are folded vertically upwardly relative to the bottom wall, the flutes extend vertically to provide maximum vertical column strength. These side walls 12 and 13 are each of a single-ply construction, namely formed by a single layer of extruded plastic panel.

As to the other pair of parallel side walls 14 and 15, in this illustrated embodiment each is of a two-ply construction formed by two layers of extruded plastic panel which directly overlie one another and are adhesively bonded or secured together. More specifically, each side wall 14 and 15 includes an outer layer 28 which is defined by a flange or flap which is integrally joined to an edge of the bottom wall 11 through a fold line 29 which extends generally parallel to the elongate flute direction of the extruded plastic panel. The side wall 14 and 15 also each includes an inner layer which is defined by a pair of flanges or flaps 31 each joined by a fold line 32 to a side edge of a respectively adjacent side wall 12 or 13. The folds 32 extend generally parallel with the elongate flute direction of the extruded plastic panel. When the blank 24 is assembled, the opposed pair of flaps 31 are folded inwardly about the fold lines 32 toward one another so as to extend in perpendicular relationship relative to the respective side walls 12 and 13, whereupon these flanges 31 overlie the inner side surface of the outer layer 28 with the free edges 34 of the flanges 31 being disposed closely adjacent one another to hence define a substantially continuous inner layer which overlies the outer layer 28. The inner layer defined by the flanges 31 is then adhesively secured, over substantially the entire outer surface thereof, to the opposed inner surface of the outer layer 28. This inner layer, as defined by the flanges 31, has the flutes extending vertically so as to provide the side walls 14 and 15 with maximum vertical column strength, and the fold lines 32 define the upright corners 35 of the container.

Figure 5:
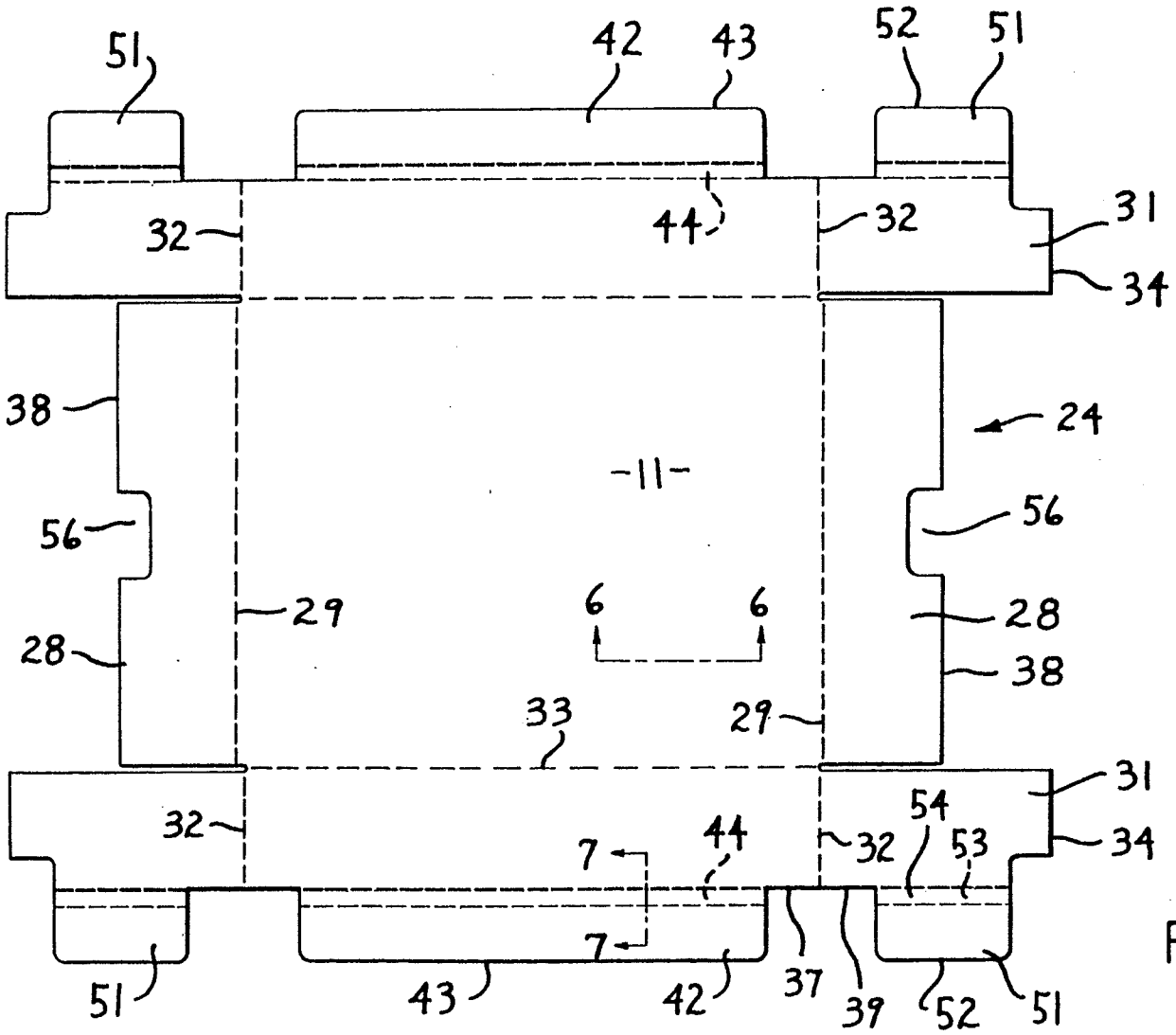
FIG. 5 is a plan view of a one-piece blank of extruded plastic panel used for constructing the container of FIG. 1.

The container of the invention, when assembled from the blank of FIG. 5, has free upper edges 37 which are defined on the side walls 12 and 13, and upper edges 38–39 as defined on the remaining side walls 14 and 15. These upper edges are all disposed within a substantially common horizontal plane. The upper edges 38–39 of the side walls 14 and 15 are defined by the free edge 38 of the outer layer 28 and the free edge 39 of the inner layer defined by the flanges 31.

Figure 9:
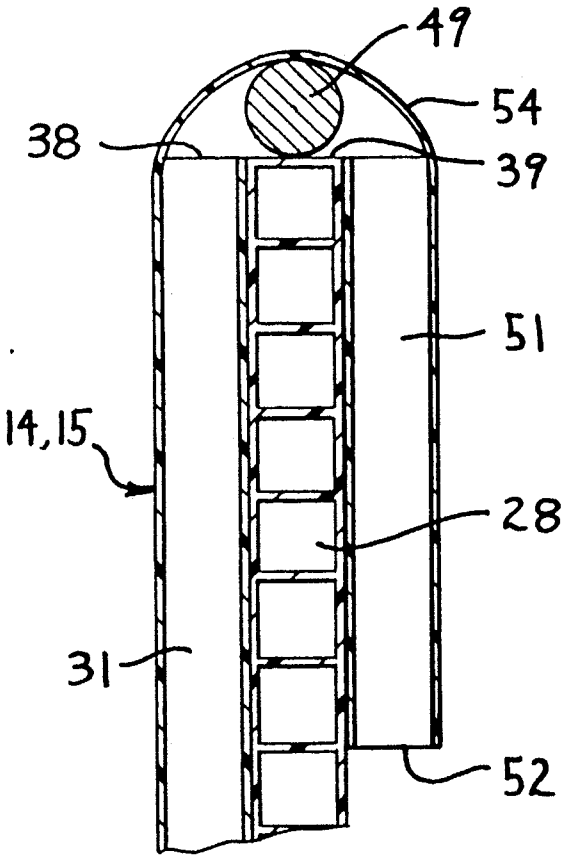
FIGS. 8 and 9 are enlarged, fragmentary sectional views taken respectively along lines 8—8 and 9—9 of FIG. 2.
Figure 8:
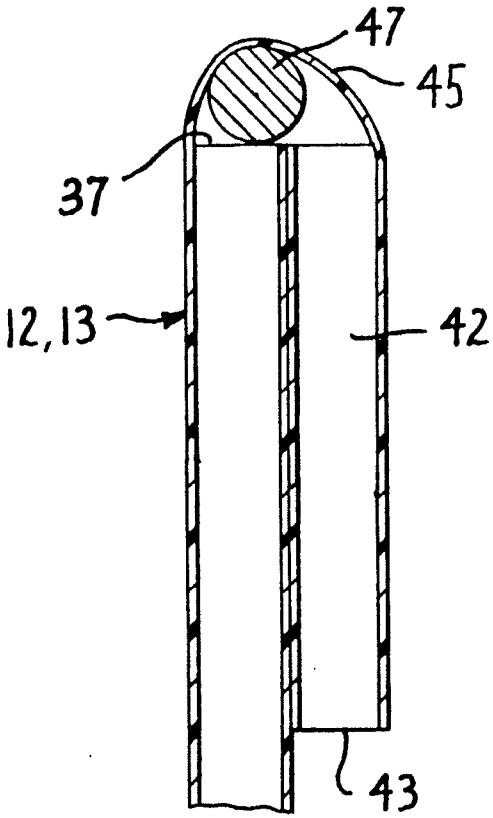

The container 10 of the present invention is also provided with a reinforcing and stacking loop 41 disposed in load bearing engagement directly over the upper free edges of the side walls 12–15, which loop is also fixedly secured to these side walls. The loop 41 is of a generally closed (i.e., endless) rectangular configuration corresponding to the size and geometry of the side wall arrangement of the container in plan view, and is preferably constructed of metal rod, such as steel which is suitably bent and welded together to define an endless loop or ring. The loop 41 includes a pair of generally parallel and elongate side rod portions 47 which are seated directly on the upper edges 37 of the side walls 12–13. These side rod portions 47 in turn are joined at opposite ends through rather sharp right angle bends 48 to a further pair of generally parallel and elongate side rod portions 49, the latter being disposed in load bearing engagement directly with the upper edges of the side walls 14–15, such as above the outer layer thereof as illustrated in FIG. 9.

Figure 7:
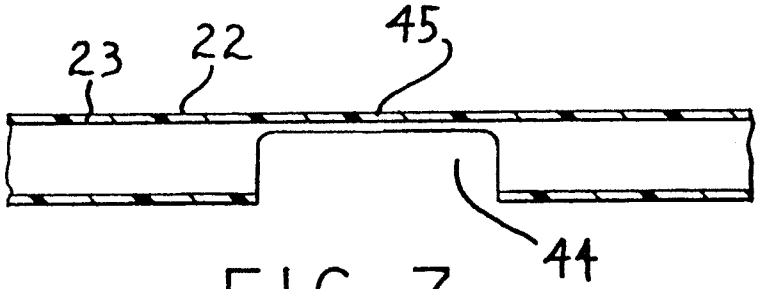
FIGS. 6 and 7 are enlarged, fragmentary sectional views taken respectively along lines 6—6 and 7—7 of FIG. 5.

To fixedly secure the loop 41 to the side wall structure of the container, each side wall 12–13 is provided with a securing flange 42 which projects outwardly beyond the edge 37 and which itself terminates in a free edge 43. This securing flange, in the illustrated embodiment, extends over a majority of the length of the respective side wall, and is provided with an undercut groove 44 therein which extends across the flange in the lengthwise direction of the respective side wall. This undercut groove 44 (FIG. 7) is cut through solely the one plastic side sheet 21 and through a majority of the thickness of the ribs 23, with this groove 44 extending in generally perpendicular relationship to the ribs or flutes, thereby leaving only a single ply section 45 as defined primarily by the other side sheet. This single ply section 45 functions as a hinge section, as explained below.

The undercut groove 44, as described above, is positioned such that one side edge of the groove (namely the groove side edge remote from the flange free edge 43) is aligned with and effectively constitutes an extension of the free edge 37 of the respective side wall 11 and 12. The width of the groove 44 is selected so as to readily accommodate therein the cross section of the side rod portion 47, whereupon this side rod portion 47 is positioned within the groove so that the single ply hinge section 45 externally wraps upwardly and then downwardly around the rod portion 47 so as to permit the securing flange 42 to be bent downwardly through an angle of about 180° so that the securing flange 42 vertically overlaps the exterior surface of the respective side wall 11–12. The overlapping areas between the securing flanges 42 and the exteriorly contacted faces of the side wall 11 and 12 are suitably adhesively fixed or bonded together whereby the securing flanges securely retain the side rod portions 47 in snug and fixed engagement with the upper edges of the side walls 12–13.

In a similar fashion, the other side rod portions 49 are fixedly secured to the upper edges of the side walls 14–15. More specifically, the flanges 31 defining the inner layer of the side walls 14–15 each have a securing flange 51 projecting outwardly beyond the edge 39 thereof, which securing flanges 51 are spaced so as to be disposed adjacent opposite ends of the respective side walls, with each securing flange 51 terminating in a free edge 52. These securing flanges 51 also have aligned undercut grooves 53 formed thereacross in a direction parallel with the upper edge of the respective side wall, which undercut grooves extend through only the one side sheet and partially through the flute-defining ribs so as to leave a single-ply hinge section 54 in the same manner as described above relative to the undercut groove 44. The side edge of the groove 53 which is remote from the free edge 52 is aligned with and in effect constitutes an extension of the upper edge 39. The securing flanges 51 are folded outwardly and downwardly through an angle of about 180° so that the side rod portions 49 are captivated within the undercut grooves 53 and the hinge sections 54 snugly wrap around the rod portions 49 to fixedly hold them in secure load bearing engagement with the upper edges of the side walls 14–15. The inner surfaces of the flanges 51, outwardly of the grooves 53, overlap the exterior surfaces of the side walls 14–15 and are adhesively fixedly secured thereto throughout the overlapping contact area.

The container 10 is also preferably provided with handles to permit manual grasping and hence manual manipulation of the container. In the illustrated embodiment the side walls 14–15 are provided with handle openings 56 which are located substantially at the middle thereof, with these handle openings in the illustrated embodiment being defined between the adjacent pair of securing flanges 51 and opening downwardly from the upper free edge 38–39. The side rod portions 49 span across the upper part of the hand openings 56, whereby these spanning rod portions function as handles to permit manual gripping of the container.

The container 10 of this invention is also provided with stacking structure which cooperates with the top loop or ring 41 to permit a plurality of like containers to be stably vertically stacked, even when the containers are loaded. The stacking structure includes a stacking bracket 61 associated with each upper corner of the container. The stacking bracket 61 includes a generally L-shaped top wire element 62 which is suitably formed from a length of wire rod and is provided with a generally 90° bend 63 intermediate the ends thereof so as to define a pair of outwardly projecting horizontal legs 64 which extend in perpendicular relationship to one another. Each horizontal leg 64 at its outer end is defined by a 90° downward bend 65 so as to terminate in a downwardly projecting cantilevered leg part 66 which terminates in a free end. The bracket 61 is positioned such that the vertical leg parts 66, adjacent the lower free ends thereof, perpendicularly cross and tangentially contact the outer sides of the side rod portions 47 and 49 in spaced relationship from the container corner, with the vertical leg parts 66 being fixedly secured, as by welding, to the side rod portions 47 and 49 at the tangential contact points. This results in the L-shaped top rod element 62 being positioned so that the horizontal legs 64 are spaced upwardly a small vertical distance above the top loop 41, with the L-shaped top rod element 62 also being disposed horizontally outwardly a small distance relative to the top loop 41, whereby innermost side surface on the L-shaped top rod element 62 is substantially vertically aligned with or disposed slightly outwardly from the outermost side contact surface of the top loop 41.

With the construction as described above, a second container 10 can be vertically stacked on a first container 10 by vertically slidably inserting the bottom portion of the upper container inside the four corner stacking brackets 61, which brackets will snugly surround and confine the four lower corners of the uppermost container, with the bottom of the uppermost container being disposed directly on and vertically supported by the top rod 41 of the lowermost container.

The overall construction and use of the container 10 is believed self-evident from the description set forth above, whereby further detail description thereof is believed unnecessary.

While the container is preferably provided with hand openings 56 disposed centrally of at least one pair of side walls, the container can also be provided with similar hand openings in the other pair of side walls if desired. Alternately, the container can also be provided with hand openings adjacent the corners thereof. For example, to supplement or replace the hand openings 56, the container can be provided with hand openings adjacent the upper edges of the corners, such as indicated by dotted lines at 69 in FIG. 1, which hand openings would be disposed under the corners of the top rod and under the corner brackets so as to facilitate manual gripping of the container in these regions.

Figure 10:
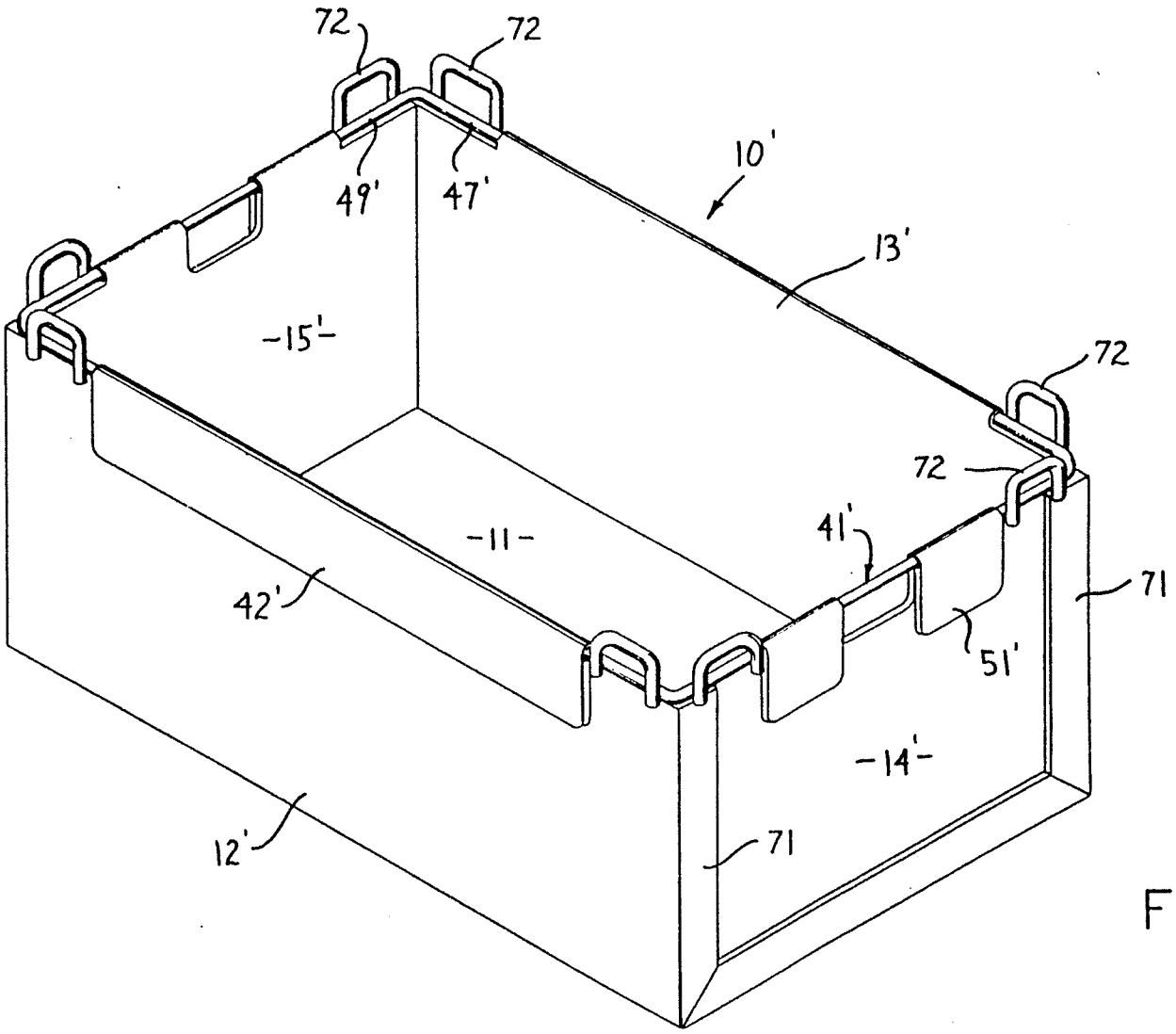
FIG. 10 is a perspective view of a container according to the present invention and showing a variation thereof.

While the embodiment illustrated by FIG. 1 forms the bottom and side walls of the container from a one-piece blank of extruded plastic panel, it will be recognized that the bottom and side walls can be constructed using two or more blanks. Reference is made to FIG. 10 which illustrates a modified container 10' which is constructed from three pieces or blanks. In the container 10', the bottom wall and parallel side walls 12' and 13' as well as the securing flanges 42' are all formed from a one-piece blank, with the flutes extending so as to be vertical within the side walls 12' and 13'. This blank is also provided with foldable securing flanges 71 on the edges of the bottom and side walls. Each remaining side wall 14' and 15' is of a separate one-piece blank oriented with the flutes extending vertically, with the blank defining this side wall being disposed so that the securing flanges 71 exteriorly overlap and are adhesively secured to the blank defining the respective side wall 14' and 15'.

The remainder of the container 10' otherwise corresponds to the construction of the container 10 except that the stacking brackets 61' are formed by two U-shaped corner elements 72. Each of the corner elements 72 is of a downwardly-opening U-shaped configuration formed from a length of metal wire or rod, whereby each element 72 has two downwardly projecting cantilevered leg parts which perpendicularly and tangentially contact the outer side of the top wire rod 41' so as to be welded thereto at all of the tangential contact points. The two elements 72 are disposed adjacent each corner, one being secured to the side rod portion 47' and the other secured to the side rod portion 49', so as to define an L-shaped confining corner which functions in the same manner as the stacking bracket 61 described above.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a container having a horizontal bottom wall, a pair of first side walls joined to a pair of opposite side edges of said bottom wall and projecting vertically upwardly therefrom in generally parallel relationship, and a pair of second side walls joined to another pair of opposite side edges of the bottom wall and projecting vertically upward therefrom in generally parallel relationship, said second side walls extending generally perpendicularly between and being fixedly joined to said first side walls at vertically-extending corners of said container, the improvement comprising:

each of said side walls being constructed of two superimposed extruded plastic panels each having substantially parallel plastic side sheets joined together by a plurality of substantially parallel plastic ribs which extend transversely between the side sheets and are rigidly joined thereto so that the ribs and side sheets cooperate to define interior elongate channels, the ribs associated with at least one said panel of each side wall being vertically oriented;

a substantially endless loop of generally rectangular configuration and constructed of elongate metal rod, said loop being of a rectangular configuration corresponding to a horizontal rectangular configuration defined by said first and second side walls, said loop being positioned vertically over and directly and vertically supportively engaged with horizontally extending upwardly facing upper free edges of said pairs of first and second side walls; and means for fixedly securing said loop on the upper free edges of said pairs of first and second side walls, said securing means including a securing flange associated with each of said first and second side walls with said securing flange passing over a top of said loop with the securing flange being bent downwardly so as to overlap and be fixedly secured to the respective side wall so that the securing flange securely holds the loop against the upper free edge of the respective side wall;

a hand-accommodating opening formed in each said first side wall, each said hand-accommodating opening extending downwardly from the upper free edge of the respective first side wall to permit gripping of the loop as it extends across an upper edge of the hand-accommodating opening.

2. A container according to claim 1, wherein each of said first and second side walls includes a vertical wall part which terminates in said respective upper edge and which has the channels extending generally vertically thereof, each said wall part having said respective securing flange integrally formed therewith and projecting outwardly beyond the upper edge thereof, each said securing flange being folded downwardly through an angle of about 180° so as to overlap an exposed side surface of the respective side wall so as to snugly and fixedly captivate the loop within the respective said groove between an arched portion of the respective securing flange and the upper free edge of the respective side wall, each said securing flange having a part which overlaps and is adhesively secured to the exposed side surface of the respective side wall.

3. A container according to claim 2, wherein each said securing flange has an undercut groove which extends thereacross in general alignment with the upper free edge of the respective wall part, each said undercut groove extending through only one of said side sheets of said respective plastic panels and transversely through at least a part of the ribs thereof so as to accommodate the loop therein, each said undercut groove having a bottom thereof defined by the other of said side sheets which functions as a flexible hinge portion which exteriorly wraps around and engages the top of the loop.

4. A container according to claim 3, including a corner bracket fixed to and projecting upwardly and outwardly from each corner of said loop for closely and sidewardly confining a bottom portion of a further said container for permitting two said containers to be vertically stacked on top of one another.

5. A container according to claim 4, wherein each said corner bracket comprises a corner member constructed of metal and including a confining wall part which is spaced vertically upwardly and horizontally outwardly a small distance from said loop adjacent one of said respective corners of the container, each said metal corner member being welded to said loop.

6. A container according to claim 5, wherein each said corner member is constructed from wire rod and includes first and second generally horizontal leg parts which extend in generally perpendicular relationship to one another adjacent said one of said respective corners of the container and are spaced vertically upwardly and horizontally outwardly so as to extend generally parallel with adjacent portions of the loop, and each said horizontal leg part being joined to a vertical leg part which projects vertically downwardly and contacts an exterior side of the loop and is fixedly welded thereto at a contact point.

7. In a container having a horizontal bottom wall, a pair of first side walls joined to a pair of opposite side edges of said bottom wall and projecting vertically upwardly therefrom in generally parallel relationship, and a pair of second side walls joined to another pair of opposite side edges of the bottom wall and projecting vertically upwardly therefrom in generally parallel relationship, said second side walls extending generally perpendicularly between and being fixedly joined to said first side walls at vertically-extending corners of said container, each of said walls being constructed of at least one extruded plastic panel having substantially parallel plastic side sheets joined together by a plurality of substantially parallel plastic ribs which extends transversely between the side sheets and are rigidly joined thereto so that the ribs and side sheets cooperate to define interior elongate channels, the improvement comprising:

a substantially endless loop of generally rectangular configuration and constructed of elongated metal rod, said loop being of a rectangular configuration corresponding to a horizontal rectangular configuration defined by said first and second pairs of side walls, said loop being supported directly on upper edges of said pairs of first and second side walls;

means for fixedly securing said loop on the upper edges of said pairs of first and second side walls, said securing means including a securing flange associated with each of said first and second side walls with said securing flange passing over a top of said loop with the securing flange being bent downwardly so as to overlap and be fixedly secured to the respective side wall so that the securing flange securely holds the loop against the upper edge of the respective side wall; and each said securing flange being constructed of said extruded plastic panel, and having an undercut groove which extends thereacross in parallel relationship to the upper edge of the respective side wall, each said groove extending through only one of said side sheets of said plastic panel for accommodating the loop therein.

8. In a container having a horizontal bottom wall, a first pair of side walls joined to a pair of opposite side edges of said bottom wall and projecting vertically upwardly therefrom in generally parallel relationship, and a pair of second side walls joined to another pair of opposite side edges of the bottom wall and projecting vertically upwardly therefrom in generally parallel relationship, said second side walls extending generally perpendicularly between and being fixedly joined to said first side walls at vertically-extending corners of said container, each of said walls being constructed of at least one extruded plastic panel having substantially parallel plastic side sheets joined together by a plurality of substantially parallel plastic ribs which extends transversely between the side sheets and are rigidly joined thereto so that the ribs and side sheets cooperate to define interior elongate channels, the improvement comprising:

a substantially endless loop of generally rectangular configuration and constructed of elongate metal rod, said loop being of a rectangular configuration corresponding to a horizontal rectangular configuration defined by said first and second side walls, said loop being supported directly on upper edges of said pairs of first and second side walls;

means for fixedly securing said loop on the upper edges of said pairs of first and second side walls, said securing means including a securing flange associated with each of said first and second side walls with said securing flange passing over a top of said loop with the securing flange being bent downwardly so as to overlap and be fixedly secured to the respective side wall so that the securing flange securely holds the loop against the upper edge of the respective side wall; and a corner bracket fixed to and projecting upwardly and outwardly from each corner of said loop for closely and sidewardly confining a bottom portion of a further said container for permitting two said containers to be vertically stacked on top of one another.

9. A container according to claim 8, wherein each said corner bracket comprises a corner member constructed of metal and including a confining wall part which is spaced vertically upwardly and horizontally outwardly a small distance from said loop adjacent one of said respective corners of the container, each said metal corner member being welded to said loop.

10. A container according to claim 9, wherein each said corner member is constructed from wire rod and includes first and second generally horizontal leg parts which extend in generally perpendicular relationship to one another adjacent said one of said respective corners of the container and are spaced vertically upwardly and horizontally outwardly so as to extend generally parallel with adjacent portions of the loop, and each said horizontal leg part being joined to a vertical leg part which projects vertically downwardly and contacts an exterior side of the loop and is fixedly welded thereto at a contact point.

11. In a container having a horizontal bottom wall, a pair of first side walls joined to a pair of opposite side edges of said bottom wall and projecting vertically upwardly therefrom in generally parallel relationship, and a pair of second side walls joined to another pair of opposite side edges of the bottom wall and projecting vertically upwardly therefrom in generally parallel relationship, said second side walls extending generally perpendicularly between and being fixedly joined to said first side walls at vertically-extending corners of said container, all of said walls being constructed of an extruded plastic panel having substantially parallel plastic side sheets joined together by a plurality of substantially parallel plastic ribs which extend transversely between the side sheets and are rigidly joined thereto so that the ribs and side sheets cooperate to define interior elongate channels, the improvement comprising:

a substantially endless loop of generally rectangular configuration and constructed of elongate metal rod, said loop being of a rectangular configuration corresponding to a horizontal rectangular configuration defined by said pairs of first and second side walls, said loop being supported directly on upper edges of said pairs of first and second side walls;

means for fixedly securing said loop on the upper edges of said pairs of first and second side walls; and stacking bracket means fixed to and projecting upwardly and outwardly from each side of said loop for closely and sidewardly confining a bottom portion of a further said container for permitting two said containers to be vertically stacked on top of one another, said bracket means including a corner bracket associated with each upper corner of the container, said corner bracket comprising a corner member constructed of metal and including a confining wall part which is spaced vertically upwardly and horizontally outwardly a small distance from said loop adjacent each corner of the container, said corner member being welded to said loop.

12. A container according to claim 11, wherein said corner member is constructed from wire rod and includes first and second generally horizontal leg parts which extend in generally perpendicular relationship to one another adjacent a said corner of the container and are spaced vertically upwardly and horizontally outwardly so as to extend generally parallel with adjacent portions of the loop, and each said horizontal leg part being joined to a vertical leg part which projects vertically downwardly and contacts an exterior side of the loop and is fixedly welded thereto at the contact point.

13. A container according to claim 11, wherein each of said first and second side walls includes a vertical wall part which terminates in said upper edge and which has the channels extending generally vertically thereof, each said wall part having a securing flange which is integrally formed with the wall part and projects outwardly beyond the upper edge thereof, said securing flange being folded downwardly through an angle of about 180° so as to overlap an exposed side surface of the respective side wall so as to snugly and fixedly captivate the loop between an arched portion of the securing flange and the upper edge of the respective side wall, said securing flange having a part which overlaps and is adhesively secured to the exposed side surface of the respective side wall.

14. A container according to claim 13, wherein each said securing flange has an undercut groove which extends thereacross in general alignment with the upper edge of the respective wall part, said undercut groove extending through only said side sheet and transversely through at least a part of the ribs so as to accommodate the loop therein, said undercut groove having a bottom thereof defined by the other said side sheet which functions as a flexible hinge portion which exteriorly wraps around and engages the top of the loop.

* * * * *

UNITED STATES PATENT AND TRADEMARK OFFICE

CERTIFICATE OF CORRECTION

PATENT NO. : 5,322,213
DATED : June 21, 1994
INVENTOR(S) : Alan T. Carter, et al It is certified that error appears in the above-indentified patent and that said Letters Patent is hereby corrected as shown below:

Column 7, line 4; change "vertically upward" to
---vertically upwardly---.

Column 9, line 16; change "ribs which extends" to
---ribs which extend---.

Column 10, line 62; "only said side" to
---only one said side---.

Signed and Sealed this

Eighth Day of November, 1994

*Attest:*

Bruce Lehman

BRUCE LEHMAN

*Attesting Officer*

*Commissioner of Patents and Trademarks*